US005603528A

United States Patent [19]

Chen

[11] Patent Number: 5,603,528

[45] Date of Patent: Feb. 18, 1997

[54] PHOTO ALBUM USABLE AS A PICTURE STAND

[76] Inventor: Cheng-Sung Chen, No. 380, Chung-Hua Rd., Tou-Liu City, Yun-Lin Hsien, Taiwan

[21] Appl. No.: 554,970

[22] Filed: Nov. 13, 1995

[51] Int. Cl.[6] ..... A47B 23/00

[52] U.S. Cl. ..... 281/33; 281/29

[58] Field of Search ..... 281/15.1, 21.1, 281/33, 29; 402/73, 70

[56] References Cited

U.S. PATENT DOCUMENTS 3,166,342 1/1965 Yenkes ..... 281/33
3,220,752 11/1965 Sloves ..... 281/33
3,270,449 9/1966 Robbie ..... 281/33
5,509,746 4/1996 Ho ..... 281/33 X

*Primary Examiner*—Willmon Fridie, Jr.
*Attorney, Agent, or Firm*—Foley & Lardner

[57] ABSTRACT

A photo album includes rigid front and rear cover pages, a plurality of picture holding sheets sandwiched between the front and rear cover pages, and a binder for hinging together connecting edge portions of the front and rear cover pages and the picture holding sheets. At least one male fastener is secured on an outer surface of one of the front and rear cover pages adjacent to the connecting edge portion, while at least one female fastener is secured on an outer surface of the other one of the front and rear cover pages adjacent to the connecting edge portion for engaging releasably a corresponding male fastener when the front cover page is turned so as to be disposed adjacent to the rear cover page.

8 Claims, 4 Drawing Sheets

PHOTO ALBUM USABLE AS A PICTURE STAND

BACKGROUND OF THE INVENTION

1. Field of the Invention

The invention relates to a photo album, more particularly to a photo album which can be used as a picture stand.

2. Description of the Related Art

A conventional photo album can only be used for storing pictures therein. If a picture is to be displayed, a separate picture stand is required.

SUMMARY OF THE INVENTION

Therefore, the object of the present invention is to provide a photo album which can be used as a picture stand.

Accordingly, the photo album of this invention comprises rigid front and rear cover pages, a plurality of picture holding sheets sandwiched between the front and rear cover pages, and a binder for hinging together connecting edge portions of the front and rear cover pages and the picture holding sheets. At least one male fastener is secured on an outer surface of one of the front and rear cover pages adjacent to the connecting edge portion. At least one female fastener is provided on an outer surface of the other one of the front and rear cover pages adjacent to the connecting edge portion for engaging releasably a corresponding male fastener when the front cover page is turned so as to be disposed adjacent to the rear cover page. The photo album can be used as a picture stand when the female fastener engages the corresponding male fastener.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
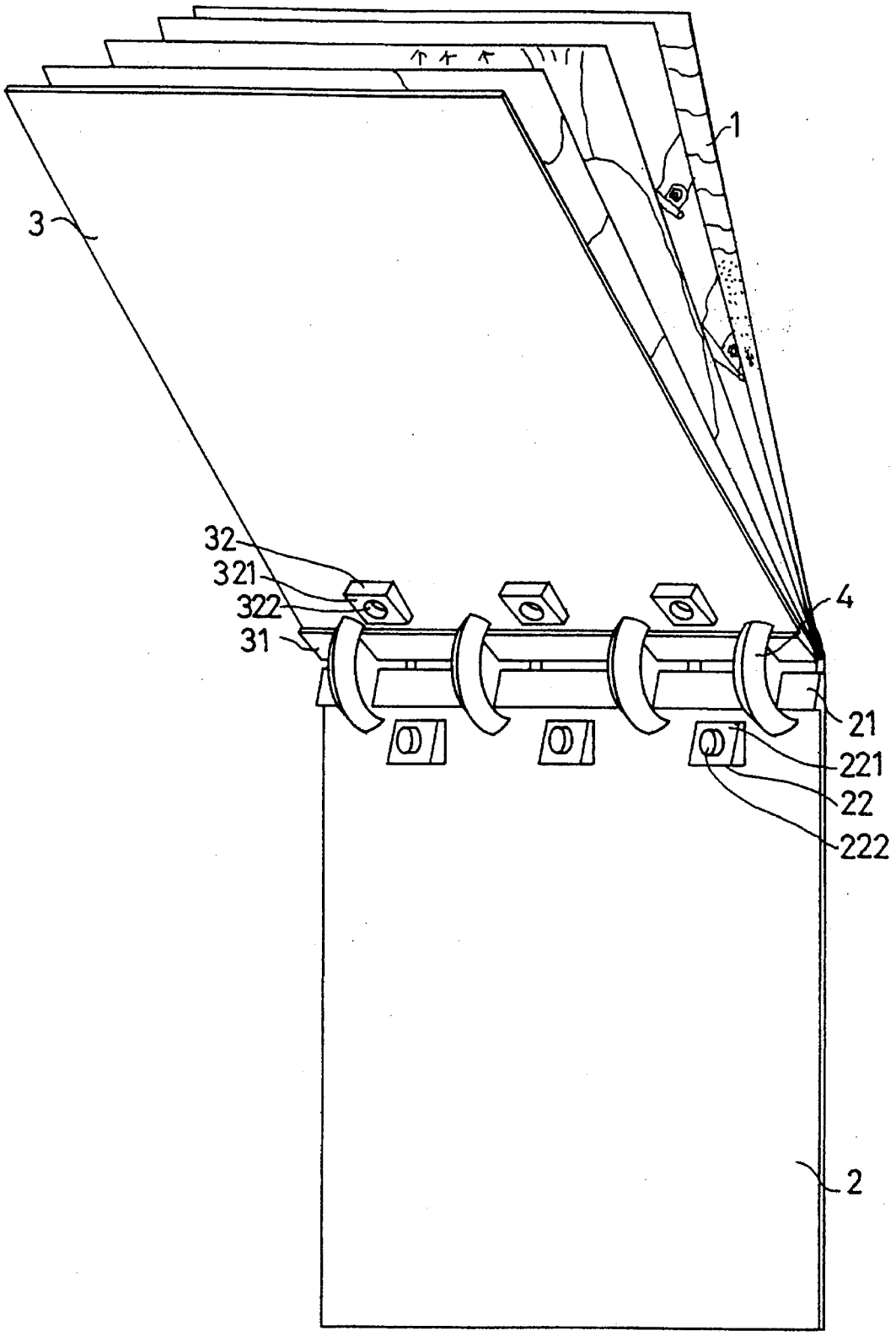
FIG. 1 is a perspective view of the first preferred embodiment of a photo album according to the present invention.

Referring to FIG. 1, the first preferred embodiment of a photo album according to the present invention is shown to comprise a plurality of rectangular picture holding sheets 1 sandwiched between rigid front and rear cover pages 2, 3 which are preferably made of plastic. The picture holding sheets 1 and the front and rear cover pages 2, 3 have connecting edge portions that are hinged together by binder units 4. In this embodiment, each of the binder units 4 is a circular plate with an annular rim which engages T-shaped slits that are formed in the connecting edge portions of the picture holding sheets 1 and the front and rear cover pages 2, 3. Each of the front and rear cover pages 2, 3 has an outer surface formed with a horizontally extending wedge-shaped projection 21, 31 at the connecting edge portion. The wedge-shaped projections 21, 31 taper gradually in a direction toward the connecting edge portions of the front and rear cover pages 2, 3. The outer surface of the front cover page 2 is further provided with three horizontally aligned male fasteners 22, while the outer surface of the rear cover page 3 is further provided with three horizontally aligned female fasteners 32. Each of the male fasteners 22 includes a wedge-shaped block 221 secured to the front cover page 2 and a plug 222 projecting from an inclined face of the block 221. Each of the female fasteners 32 includes a wedge-shaped block 321 secured to the rear cover page 3 and a socket 322 formed through an inclined face of the block 321 for engaging the plug 222 of a corresponding one of the male fasteners 22. The blocks 221, 321 also taper gradually toward the connecting edge portions of the front and rear cover pages 2, 3.

Figure 2:
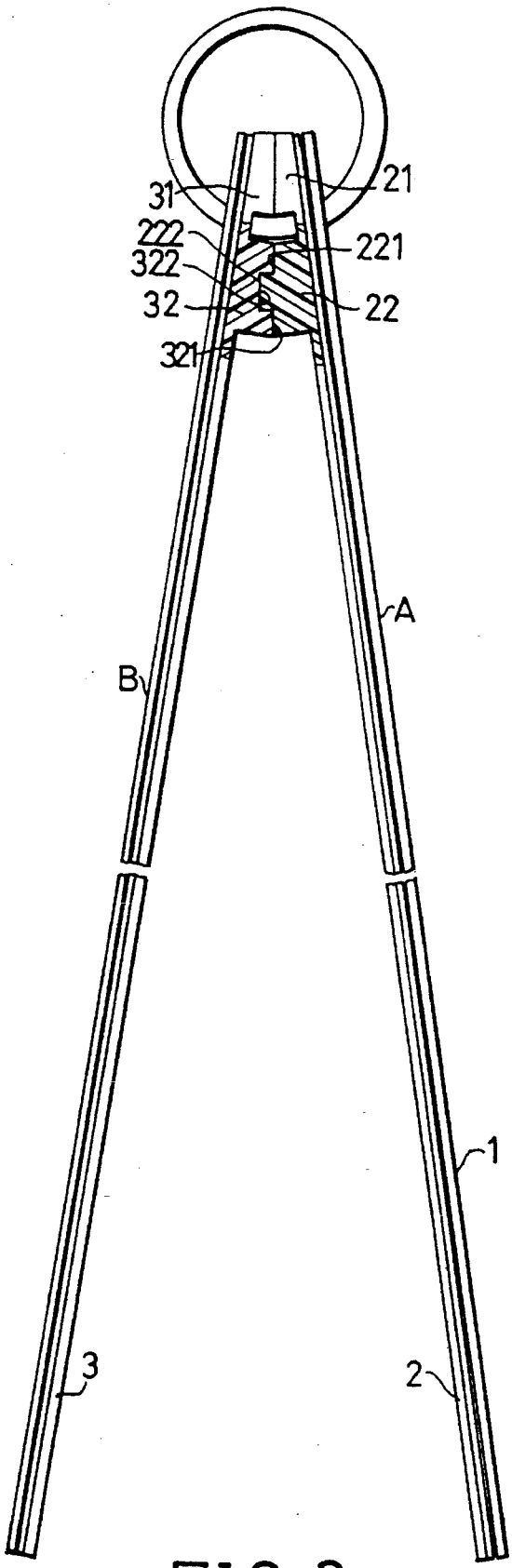
FIG. 2 is a schematic side view illustrating the first preferred embodiment when in use.

Referring to FIG. 2, in use, the front cover page 2 is turned so as to be disposed adjacent to the rear cover page 3. At this time, the male fasteners 22 are aligned with the female fasteners 32 to permit insertion of the plugs 222 of the male fasteners 22 into the sockets 322 of the female fasteners 32. Thus, the photo album can be made to stand on a horizontal support surface, such as a table surface, for use as a picture stand. The picture holding sheets 1 may then be turned so as to display a selected one of the pictures at the position (A) or (B). When it is desired to store the photo album, the front and rear cover pages 2, 3 are simply pulled apart to disengage the male fasteners 22 from the female fasteners 32, thereby enabling the front and rear cover pages 2, 3 to once more sandwich the picture holding sheets 1 therebetween.

Note that the wedge-shaped projections 21, 31 on the front and rear cover pages 2, 3 and the inclined faces of the blocks 221, 321 of the male and female fasteners 22, 32 abut against each other when the male fasteners 22 engage the female fasteners 32. Thus, the contact area between the front and rear cover pages 2, 3 is increased to enhance stability when the photo album is used as a picture stand.

Figure 3:
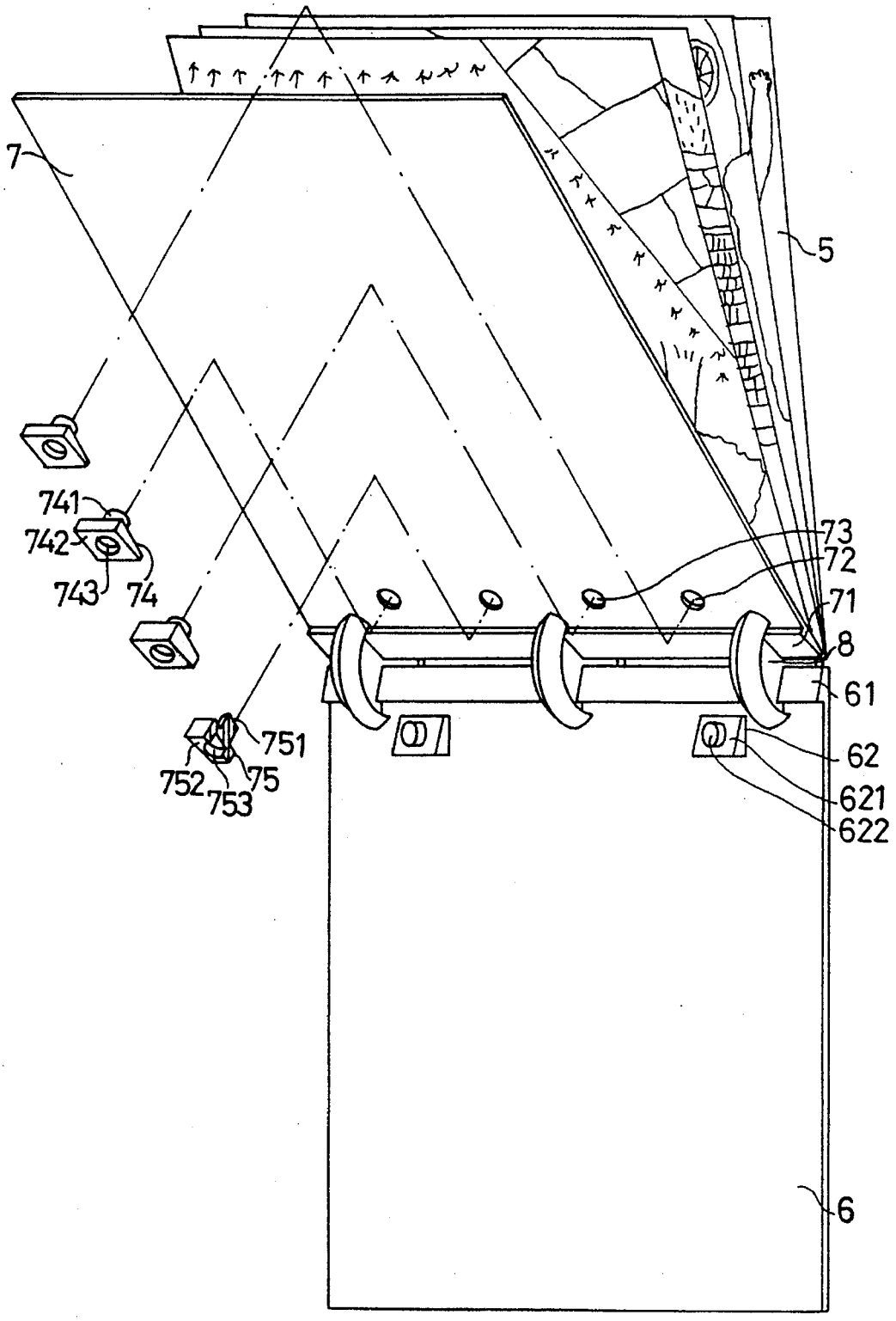
FIG. 3 is a perspective, partly exploded view of the second preferred embodiment of a photo album according to the present invention.

Referring to FIG. 3, the second preferred embodiment of a photo album according to the present invention is shown to also comprise a plurality of rectangular picture holding sheets 5 sandwiched between rigid front and rear cover pages 6, 7. As with the previous embodiment, the picture holding sheets 5 and the front and rear cover pages 6, 7 have connecting edge portions that are hinged together by binder units 8. Each of the front and rear cover pages 6, 7 has an outer surface formed with a horizontally extending wedge-shaped projection 61, 71 at the connecting edge portion. The wedge-shaped projections 61, 71 taper gradually in a direction toward the connecting edge portions of the front and rear cover pages 6, 7. The outer surface of the front cover page 6 is further provided with a pair of horizontally aligned male fasteners 62. Each of the male fasteners 62 includes a wedge-shaped block 621 secured to the front cover page 6 and a plug 622 projecting from an inclined face of the block 621. The block 621 tapers gradually toward the connecting edge portion of the front cover page 6. The outer surface of the rear cover page 7 is further formed with a horizontally aligned pair of first mounting holes 72 and a pair of second mounting holes 73 adjacent to the first mounting holes 72. The first and second mounting holes 72, 73 are used to mount female fasteners on the rear cover page 7. In this embodiment, first and second pairs of female fasteners 74, 75 are available for engaging the male fasteners 62. Each of the first and second female fasteners 74, 75 includes a wedge-shaped block 742, 752, an insert stub 741, 751 projecting from the block 742, 752 and engaging removably and selectively one of the first and second mounting holes 72, 73 to secure the first and second female fasteners 74, 75 on the rear cover page 7, and a socket 743, 753 formed through an inclined face of the block 742, 752 and capable of engaging the plug 622 of one of the male fasteners 62. The blocks 742, 752 taper gradually toward the connecting edge portion of the rear cover page 6, 7. The blocks 752 of the second female fasteners 75, however, are thicker than the blocks 742 of the first female fasteners 74.

Figure 4:
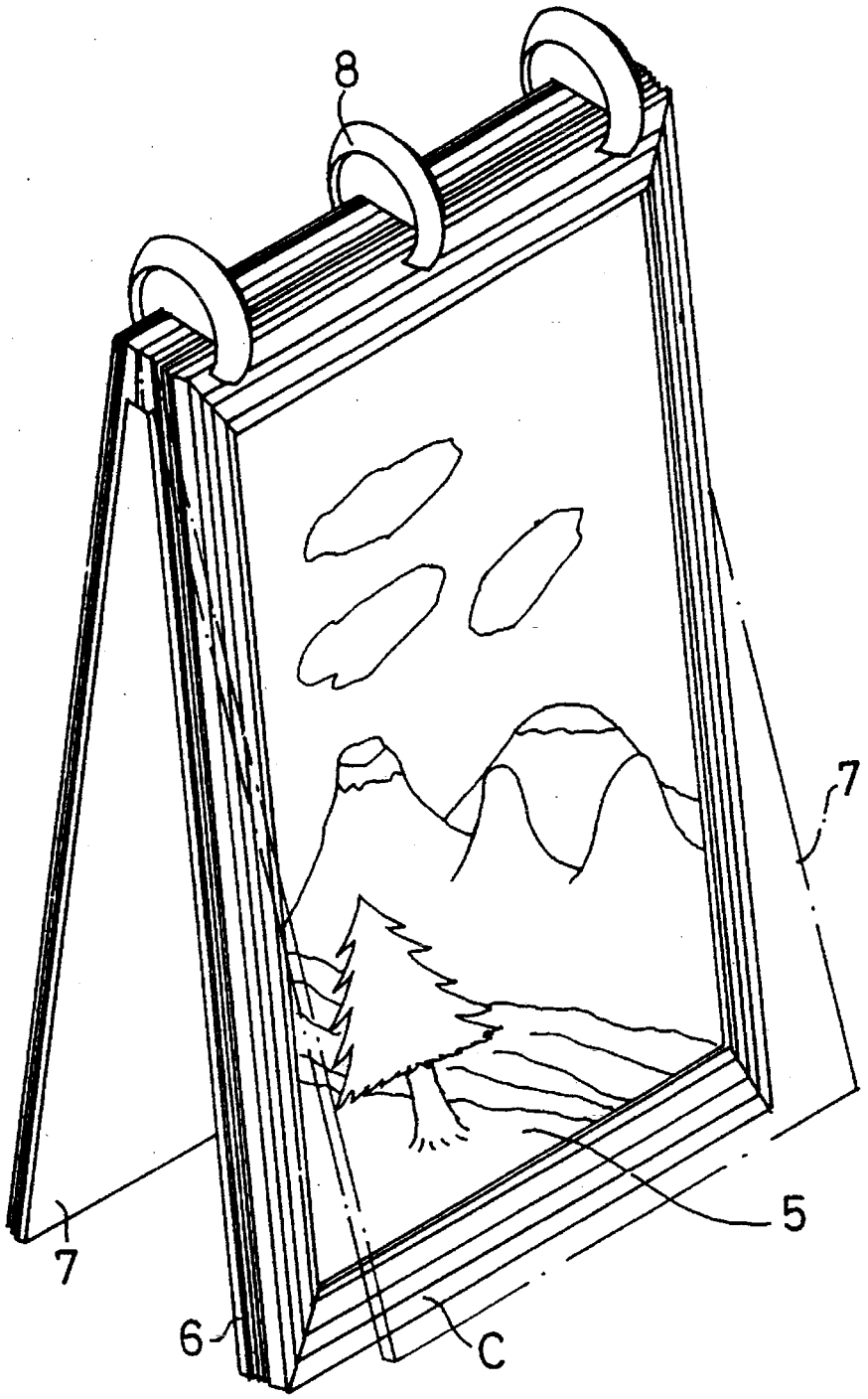
FIG. 4 illustrates the second preferred embodiment when in use.

In use, the insert stubs 741, 751 of a selected one of the first or second female fasteners 74, 75 engage the first mounting holes 72 in the rear cover page 7, thereby aligning the selected one of the first or second female fasteners 74, 75 with the male fasteners 62 to permit engagement therebetween when the front cover page 6 is turned so as to be disposed adjacent to the rear cover page 7. Since the blocks 742, 752 of the first and second female fasteners 74, 75 have different thicknesses, the photo album can be made to stand while the front and rear cover pages 6, 7 form different angles therebetween. This design permits the consumer to place the photo album properly at a desired location to obtain the best angle for viewing pictures. As shown in FIG. 4, when it is desired to place the photo album in a relatively high location, the first female fasteners 74, which are thinner than the second female fasteners 75, are used to engage the male fasteners 62. Thus, the front and rear cover pages 6, 7 form a smaller angle therebetween so that an optimum viewing angle is attained when the consumer looks up to the photo album. Accordingly, when it is desired to place the photo album in a relatively low location, the second female fasteners 75 are used to engage the male fasteners 62. Thus, the front and rear cover pages 6, 7 form a larger angle therebetween so that, when the consumer looks down to the photo album, an optimum viewing angle can be attained.

As shown in FIG. 4, an optional decorative picture frame (C) can be secured removably and turnably on the binder units 8 of the photo album to enhance appearance of the picture being displayed. The decorative frame (C) may have opposite sides formed in different designs to offer the consumer with more options. In addition, the decorative frame (C) may be a plastic frame with the appearance of a wooden frame, or may be made from other materials.

It should be noted that the male and female fasteners employed in the present invention should not be limited to the plug and socket construction described beforehand. Hook and loop fasteners may also be employed to join together the front and rear cover pages when using the photo album of this invention as a picture stand.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A photo album comprising:

rigid front and rear cover pages, a plurality of picture holding sheets sandwiched between said front and rear cover pages, a binder for hinging together connecting edge portions of said front and rear cover pages and said picture holding sheets, at least one male fastener secured on an outer surface of one of said front and rear cover pages adjacent to said connecting edge portion, and at least one first female fastener secured on an outer surface of the other one of said front and rear cover pages adjacent to said connecting edge portion for engaging releasably a corresponding said male fastener when said front cover page is turned so as to be disposed adjacent to said rear cover page, whereby said photo album can be used as a picture stand when said first female fastener engages the corresponding said male fastener, wherein said outer surface of each of said front and rear cover pages is formed with a horizontally extending wedge-shaped projection at said connecting edge portion of said front and rear cover pages, said wedge-shaped projections of said front and rear cover pages tapering gradually in a direction toward said connecting edge portions of said front and rear cover pages and abutting against each other when said first female fastener engages the corresponding said male fastener.

2. The photo album as claimed in claim 1, wherein:

said male fastener includes a wedge-shaped block secured to said one of said front and rear cover pages and provided with an inclined face and a plug projecting from said inclined face;

said first female fastener includes a wedge-shaped block secured to the other one of said front and rear cover pages and provided with an inclined face and a socket formed through said inclined face, said socket engaging removably said plug of the corresponding said male fastener;

said blocks of said male and female fasteners taper gradually toward said connecting edge portion of said front and rear cover pages and abut against each other when said first female fastener engages the corresponding said male fastener.

3. The photo album as claimed in claim 1, further comprising at least one second female fastener having a thickness different from that of said first female fastener, said first female fastener being mounted removably on the other one of said front and rear cover pages to permit replacement thereof by said second female fastener, said second female fastener being capable of engaging releasably the corresponding said male fastener when mounted on the other one of said front and rear cover pages.

4. The photo album as claimed in claim 1, further comprising a decorative picture frame secured removably and turnably on said binder.

5. A photo album comprising:

rigid front and rear cover pages, a plurality of picture holding sheets sandwiched between said front and rear cover pages, a binder for hinging together connecting edge portions of said front and rear cover pages and said picture holding sheets, at least one male fastener secured on an outer surface of one of said front and rear cover pages adjacent to said connecting edge portion, and at least one first female fastener secured on an outer surface of the other one of said front and rear cover pages adjacent to said connecting edge portion for engaging releasably a corresponding said male fastener when said front cover page is turned so as to be disposed adjacent to said rear cover page, whereby said photo album can be used as a picture stand when said first female fastener engages the corresponding said male fastener; and at least one second female fastener having a thickness different from that of said first female fastener, said first female fastener being mounted removably on the other one of said front and rear cover pages to permit replacement thereof by said second female fastener, said second female fastener being capable of engaging releasably the corresponding said male fastener when mounted on the other one of said front and rear cover pages.

6. The photo album as claimed in claim 5, wherein said outer surface of each of said front and rear cover pages is formed with a horizontally extending wedge-shaped projection at said connecting edge portion of said front and rear cover pages, said wedge-shaped projections of said front and rear cover pages tapering gradually in a direction toward said connecting edge portions of said front and rear cover pages and abutting against each other when said first female fastener engages the corresponding said male fastener.

7. A photo album comprising:

rigid front and rear cover pages, a plurality of picture holding sheets sandwiched between said front and rear cover pages, a binder for hinging together connecting edge portions of said front and rear cover pages and said picture holding sheets, at least one male fastener secured on an outer surface of one of said front and rear cover pages adjacent to said connecting edge portion, and at least one first female fastener secured on an outer surface of the other one of said front and rear cover pages adjacent to said connecting edge portion for engaging releasably a corresponding said male fastener when said front cover page is turned so as to be disposed adjacent to said rear cover page, whereby said photo album can be used as a picture stand when said first female fastener engages the corresponding said male fastener; and a decorative picture frame secured removably and turnably on said binder.

8. The photo album as claimed in claim 7, wherein said outer surface of each of said front and rear cover pages is formed with a horizontally extending wedge-shaped projection at said connecting edge portion of said front and rear cover pages, said wedge-shaped projections of said front and rear cover pages tapering gradually in a direction toward said connecting edge portions of said front and rear cover pages and abutting against each other when said first female fastener engages the corresponding said male fastener.

* * * * *